US010550587B2

(12) United States Patent
Marcon

(10) Patent No.: US 10,550,587 B2
(45) Date of Patent: Feb. 4, 2020

(54) ROLLING BASE FOR A TELESCOPIC MAST OF A PLATE-LIFTING APPARATUS, APPARATUS EQUIPPED WITH THIS BASE, AND IMPLEMENTATION METHOD

(71) Applicant: ÉTABLISSEMENTS PIERRE GRÉHAL ET CIE SA, Baillet en France (FR)

(72) Inventor: Lionel Marcon, Parmain (FR)

(73) Assignee: ETABLISSEMENTS PIERRE GREHAL ET CIE SA, Baillet-en-France (FR)

( * ) Notice: Subject to any disclaimer, the term of this patent is extended or adjusted under 35 U.S.C. 154(b) by 40 days.

(21) Appl. No.: 15/523,686

(22) PCT Filed: Oct. 2, 2015

(86) PCT No.: PCT/FR2015/052661
§ 371 (c)(1),
(2) Date: May 2, 2017

(87) PCT Pub. No.: WO2016/071591
PCT Pub. Date: May 12, 2016

(65) Prior Publication Data

US 2018/0274248 A1 Sep. 27, 2018

(30) Foreign Application Priority Data

Nov. 6, 2014 (FR) ..... 14 60724

(51) Int. Cl.
*E04F 21/18* (2006.01)

(52) U.S. Cl.
CPC ..... *E04F 21/18* (2013.01); *E04F 21/1805* (2013.01)

(58) Field of Classification Search
CPC ..... E04F 21/18; E04F 21/1805
(Continued)

(56) References Cited

U.S. PATENT DOCUMENTS 2,443,349 A * 6/1948 Foster ..... B66B 9/16 182/141
2,465,206 A 3/1949 Davis
(Continued)

FOREIGN PATENT DOCUMENTS

EP 1 302 607 4/2003
EP 1 536 084 6/2005
(Continued)

*Primary Examiner* — Lynn E Schwenning
(74) *Attorney, Agent, or Firm* — Clark & Brody

(57) ABSTRACT

A rolling base comprises, for use, a pair of fastening plates for fastening to a foot of the mast, each plate having a symmetry axis; —three arms, each having an orientable castor, including one fixed arm in the extension of the symmetry axis of the plates, and two swivelling arms symmetrically arranged on either side of the fixed arm. Each plate comprises on each side of the symmetry axis at least three means for locking the swivelling arms in three different angular positions relative to the symmetry axis. For storage, each swivelling arm is parallel to the fixed arm and to the symmetry axis of the plates. For transport under load, each swivelling arm forms an angle to the symmetry axis of more than 105°. For vertical fastening position, each swivelling arm forms an angle to the symmetry axis of more than 90° and less than that in transport.

15 Claims, 2 Drawing Sheets

Figure 1:
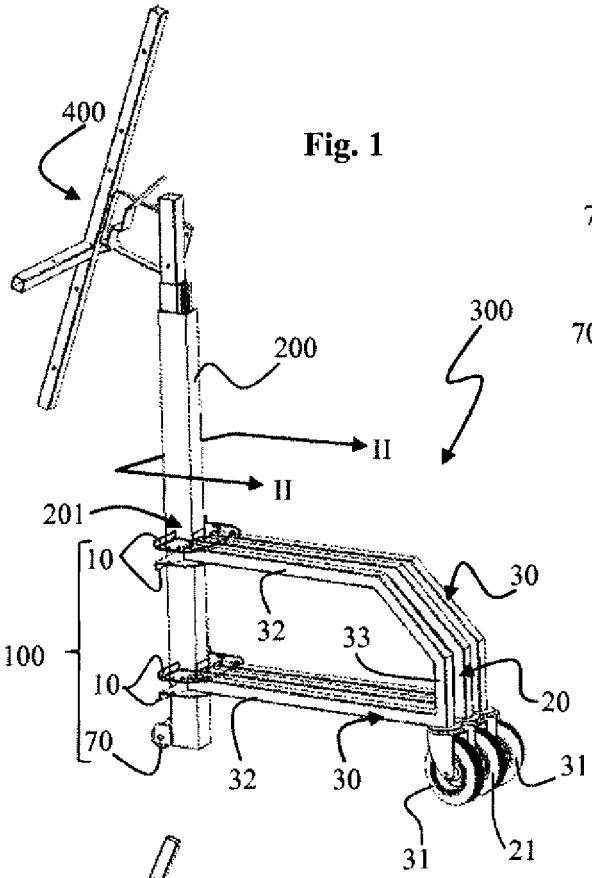

(58) Field of Classification Search
USPC ..... 414/10–12, 23; 248/131
See application file for complete search history.

(56) References Cited

U.S. PATENT DOCUMENTS

| | | | | | |
|---|---|---|---|---|---|
| 2,966,993 | A * | 1/1961 | Cooper | ..... | B66F 1/06 248/407 |
| 3,314,553 | A | 4/1967 | Vircks | | |
| 4,621,849 | A * | 11/1986 | Berfield | ..... | B60R 19/02 16/18 CG |
| 7,494,312 | B2 * | 2/2009 | Valette | ..... | E04F 21/1822 280/79.7 |
| 7,997,545 | B2 * | 8/2011 | Holland | ..... | A47G 29/1216 232/39 |

FOREIGN PATENT DOCUMENTS

| | | | | | |
|---|---|---|---|---|---|
| EP | 1 640 531 | | 3/2006 | | |
| EP | 2 508 467 | | 10/2012 | | |
| FR | 2 538 437 | | 6/1984 | | |
| FR | 2556300 | * | 6/1985 | ..... | B62B 3/02 |
| FR | 2556300 EN | * | 6/1985 | ..... | B62B 3/02 |

* cited by examiner

ROLLING BASE FOR A TELESCOPIC MAST OF A PLATE-LIFTING APPARATUS, APPARATUS EQUIPPED WITH THIS BASE, AND IMPLEMENTATION METHOD

The invention concerns a rolling base for a telescopic mast of a plate-lifting apparatus, an apparatus equipped with such a base, and an implementation method.

In particular, the invention concerns lifting and handling apparatus used during construction work for manipulating and positioning heavy objects, such as material plates (plasterboard, wood panels etc.), in order to produce suspended ceilings or ceilings on sloping walls or partitions.

This type of apparatus, called a plate lift, has already been described for example in document FR2538437.

The general structure of a plate lift is as follows: a telescopic mast which can be controlled by a lifting mechanism is mounted on a rolling base. A plate support or "plate carrier" is mounted pivotably at the end of the mast via a pivot mechanism.

The telescopic mast comprises a first fixed element and at least one telescopic element which is movable relative to the fixed element. In general, the mast comprises two telescopic movable elements.

Plate lifts are available for vertical fixing of plates, such as described in document EP1536084 or in document EP1640531.

These plate lifts have a rolling base comprising a fixed rolling arm positioned on the mast opposite the side where the plate carrier pivots to the vertical, and two arms mounted pivotably on the mast between a retracted position when the apparatus is not in use and a deployed position when the apparatus is in use. In the deployed position, the arms form a mutual angle sufficiently large for the arms not to touch the wall when the material plate is applied against the wall using the apparatus.

In practice, these apparatuses are unstable since all the weight is applied to the front of the plate lift (i.e. opposite the fixed arm relative to the mast), and the pivotable arms are too far apart to ensure good stability. The user must therefore exert significant forces during the transport between the location of the plate lift on loading of the plate and the wall against which the plate is to be fixed.

To remedy this problem, as much of the weight as possible is located at the rear of the plate lift (i.e. on the side of the fixed arm): in documents EP1536084 and EP1640531, this is the winch which is greatly offset towards the rear and associated with a heavy metal structure.

These plate lifts are therefore heavy and complex. Also, it is necessary to dismantle them to move from one room to the next, since the base is wider than standard doors.

The present invention therefore proposes a plate lift which is balanced irrespective of the inclination (horizontal, angular or vertical of the plate support), safe (i.e. limiting the risks of tilting on transport between the loading location and the plate fixing location), ergonomic, and easy to move from one room to the next.

To this end, the object of the invention is a rolling base for a telescopic mast of a plate-lifting apparatus, comprising, with reference to the usage position:

- three arms each equipped with an orientable castor, a fixed arm being fixed to the mast and two arms being mounted pivotably relative to the mast, symmetrically and on either side of the fixed arm;
- at least three blocking means for each pivotable arm at three different angular positions relative to the fixed arm:

a. a first blocking means corresponding to a minimal angular position called the "storage position", in which each pivotably mounted arm is parallel to the fixed arm;
  b. a second blocking means corresponding to a maximal angular position called the "loaded transport position", in which each pivotably mounted arm forms an angle with the fixed arm which is greater than 105°, preferably between 110° and 160°, advantageously around 120°;
  c. a third blocking means corresponding to a first intermediate position called the "vertical fixing position", in which each pivotably mounted arm forms an angle with the fixed arm which is greater than 90° and less than that of the loaded transport position, preferably between 100° and 115°, provided that this angle remains less than that of the loaded transport position.

According to other embodiments:

- the base may comprise, with reference to the usage position:
  - at least one pair of plates intended to be fixed to a foot of a lifting-apparatus mast, each plate having an axis of symmetry;
  - three arms, each provided with an orientable castor, one arm being fixed between the plates in the extension of the axis of symmetry of the plates, and two arms being mounted pivotably between the plates, symmetrically and on either side of the fixed arm;
  - each plate comprising, on each side of the axis of symmetry, at least three means for blocking the pivotable arms in three different angular positions relative to the axis of symmetry:
    - a first blocking means corresponding to a minimal angular position called the "storage position", in which each pivotably mounted arm is parallel to the fixed arm and to the axis of symmetry of the plates;
    - a second blocking means corresponding to a maximal angular position called the "loaded transport position", in which each pivotably mounted arm forms an angle with the axis of symmetry which is greater than 105°;
    - a third blocking means corresponding to a first intermediate position called the "vertical fixing position", in which each pivotably mounted arm forms an angle with the axis of symmetry which is greater than 90° and less than that of the loaded transport position;
- each plate may also comprise, on each side of the axis of symmetry, a fourth means for blocking the pivotable arms at a second intermediate angular position called the "unloaded transport position", in which each pivotably mounted arm forms an angle with the axis of symmetry which is less than 90° and greater than that of the storage position;
- the base may comprise two pairs of plates, the arms being each formed by a lying U-shaped bracket, each leg of which is mounted pivotably between two plates of a same pair;
- the angle formed between each arm and the axis of symmetry in the loaded transport position may lie between 105° and 160°;
- the angle formed between each arm and the axis of symmetry in the vertical fixing position may lie between 100° and 115°, provided that this angle remains less than that of the loaded transport position;

the angle formed between each arm and the axis of symmetry in the unloaded transport position may lie between 15° and 45°;

the angular blocking means may be holes intended to be brought to face holes carried by each pivotable arm and intended to receive a removable blocking pin;

the rolling base may also comprise a return means intended to be fixed removably between the two pivotable arms when the latter are in the loaded transport position;

on each pivotable arm, a rotationally mounted buffer may be interposed between each orientable castor and each arm, each buffer having a maximum diameter which is greater than a maximum diameter of the orientable castors;

at least one plate may comprise a limit switch to limit a predefined maximal angular opening of the pivotable arms relative to the axis of symmetry; and/or the blocking means may consist of at least three holes carried by each of the two pivotably mounted arms and of two hooks carried by the fixed arm or by the mast.

The invention also concerns an apparatus for lifting construction plates comprising a mast, a lifting mechanism, an orientable plate support, and a rolling base as described above, fixed to a mast foot.

The lifting apparatus may also comprise a castor fixed to the foot of the mast by a pin perpendicular to the axis of symmetry of the plates, the diameter of the castor and the position of its pin being selected such that:

the castor does not touch the ground when the rolling pivotable arms are deployed in the loaded transport position and in the vertical fixing position; and the castor comes into contact with the ground when the pivotable arms are deployed in the unloaded transport position, a tilt angle of the mast between the loaded transport position or the vertical fixing position and the unloaded transport position lying between 1° and 4°.

The invention also concerns a method for positioning and fixing a plate on a vertical support using a lifting apparatus as described above, comprising the following steps:

a1) supplying a lifting apparatus as described above;

b1) arranging the arms in the loaded transport position;

c1) fixing the return means between the arms;

d1) placing a construction plate on the plate support;

e1) orienting the plate support vertically such that the plate is vertical;

f1) moving the apparatus towards the vertical support until the castors come into contact with the vertical support;

g1) pushing the apparatus against the vertical support such that the pivotable arms move apart relative to the return means until the material plate is resting against the vertical support;

h1) fixing the plate;

i1) moving the apparatus away from the vertical support such that the pivotable arms are returned to the loaded transport position by the return means.

If the base comprises transport buffers, the method comprises, instead of step f1), a step f2) comprising moving the apparatus towards the vertical support until the buffers come into contact with the vertical support.

Figure 2:
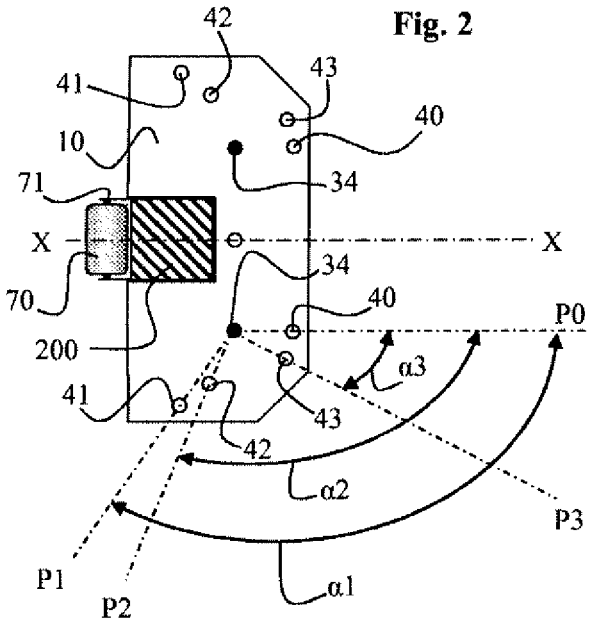
Figure 3:
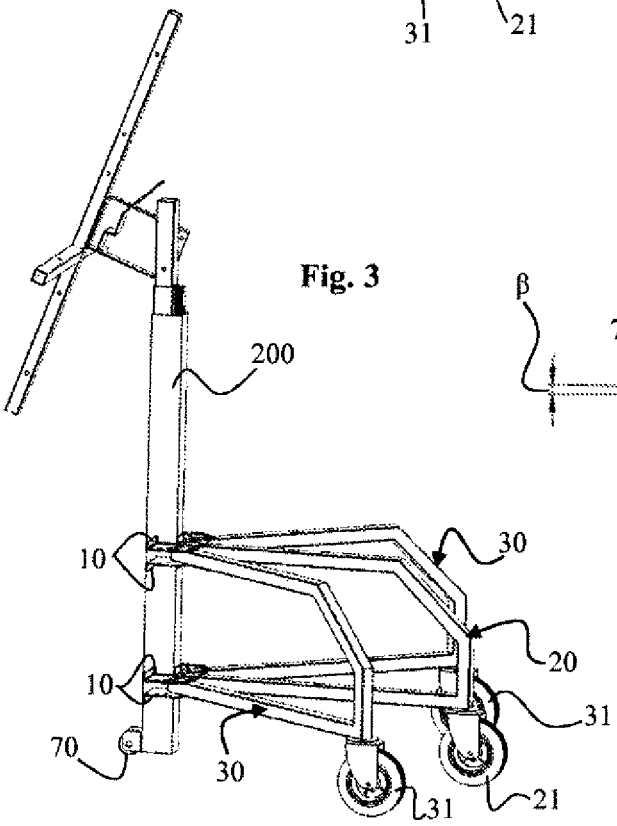
Figure 4:
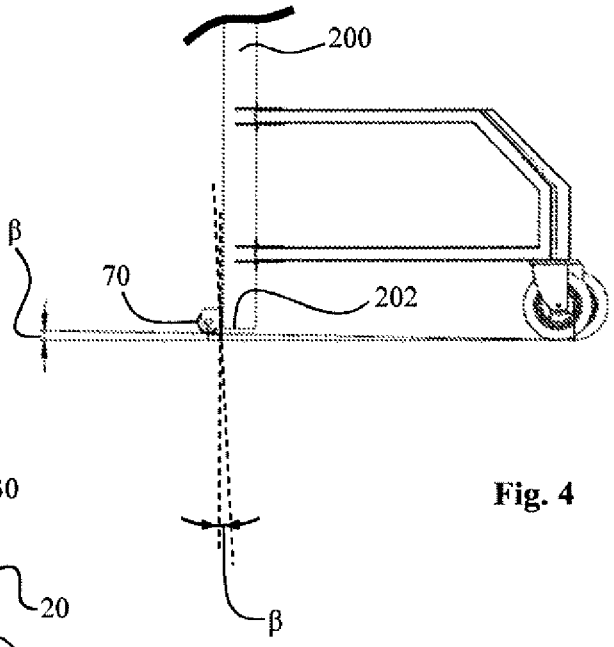
Figure 5:
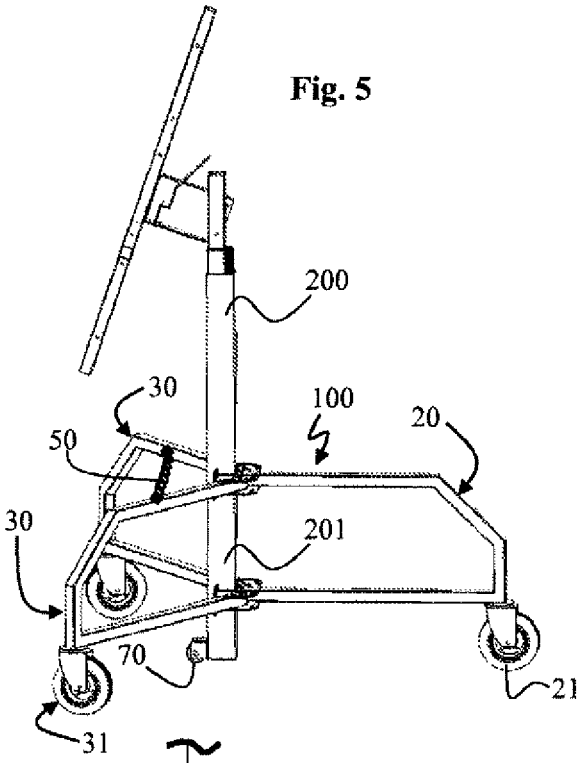
Figure 6:
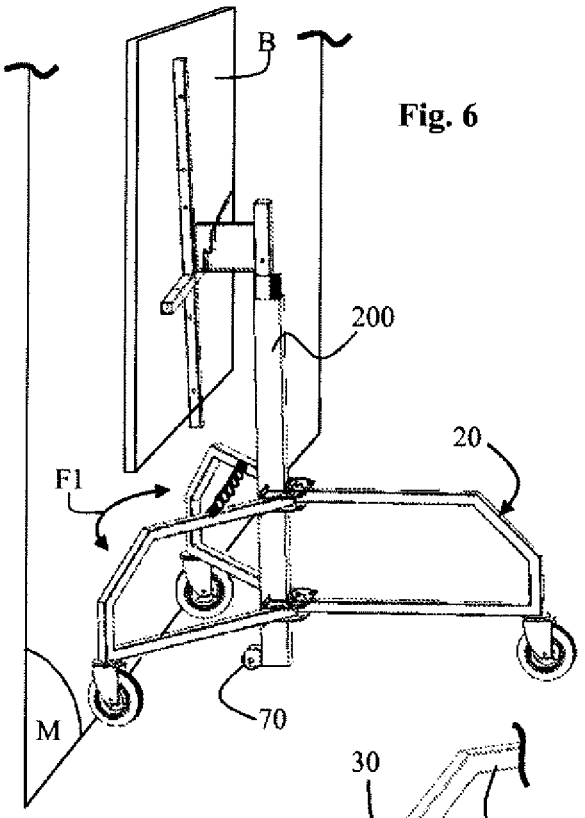
Figure 7:
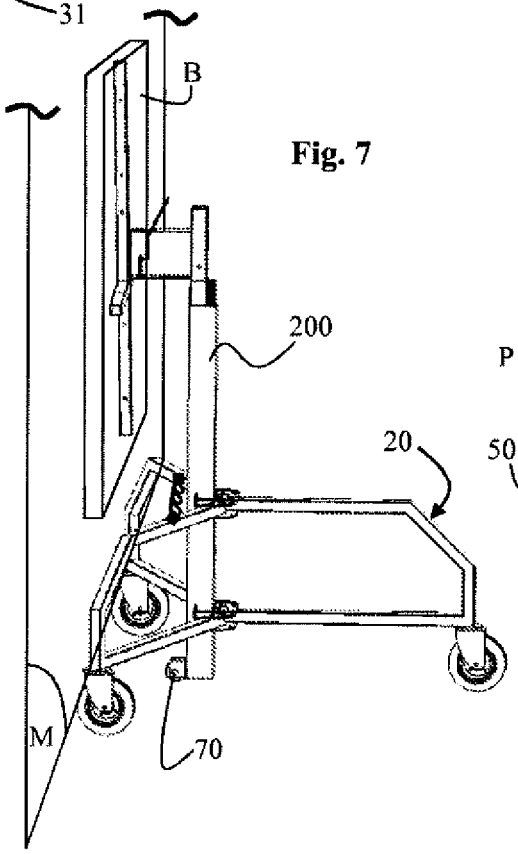
Figure 8:
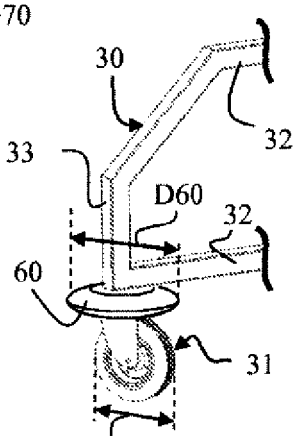
Figure 9:
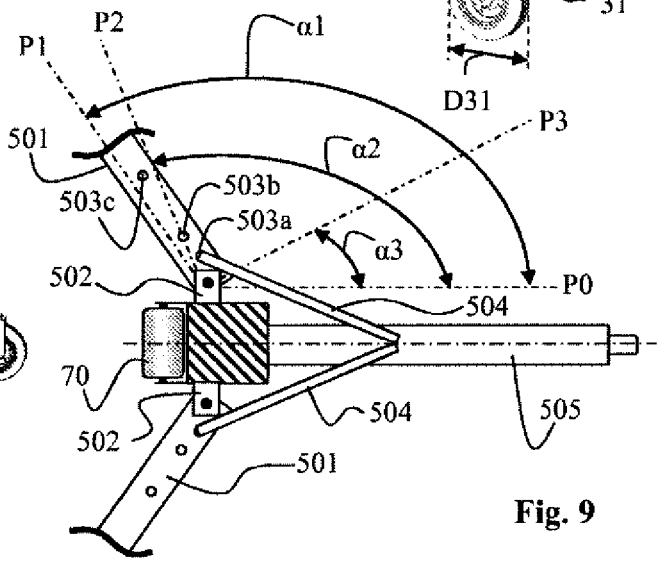

Further characteristics of the invention will be described in the detailed description below, given with reference to the attached drawings which respectively depict:

FIG. 1: a diagrammatic, perspective view of a plate lift equipped with a rolling base according to the invention in the storage position;

FIG. 2: a diagrammatic, plan view of a plate for fixing the arms of a base according to the invention;

FIG. 3: a diagrammatic, perspective view of the plate lift of FIG. 1 in the unloaded transport position;

FIG. 4: a diagrammatic, profile view of a rolling base according to the invention in the unloaded transport position;

FIG. 5: a diagrammatic, perspective view of the plate lift in FIG. 1 in the loaded transport position;

FIG. 6: a diagrammatic, perspective view of the plate lift of FIG. 5, in which the plate carrier has been tilted to the vertical with the aim of vertical fixing of a plate;

FIG. 7: a diagrammatic, perspective view of the plate lift of FIG. 6 in the vertical fixing position;

FIG. 8: a partial, diagrammatic, perspective view of an arm of a rolling base according to the invention equipped with a transport buffer; and FIG. 9: a partial, diagrammatic, plan view of a second embodiment of a base according to the invention.

FIG. 1 illustrates a plate lift fitted with a rolling base according to the invention in the retracted position.

The plate lift 300 comprises a telescopic mast 200, at the upper end of which a plate support 400 is fixed in a pivotable fashion.

At the lower end of the mast 200 is a foot 201 on which the base 100 according to the invention is fixed.

With reference to the usage position, the rolling base 100 comprises at least one pair of plates 10 intended to be fixed to the foot 201 of the mast 200.

Each plate 10 comprises an axis of symmetry XX (see FIG. 2).

The rolling base also comprises three arms 20, 30, each equipped with an orientable castor 21, 31; one arm 20 being fixed relative to the plates 10 and extending in the extension of the axis of symmetry XX of the plates. Two arms 30 are mounted pivotably between the plates, symmetrically and on either side of the fixed arm 20.

Advantageously, the rolling base comprises two pairs of plates, ensuring better stability of the base, in particular when the pivotably mounted arms 30 are each formed by a lying U-shaped bracket, each leg 32 of which is mounted pivotably between two plates of a same pair.

FIG. 2 illustrates a plate viewed from above along section line 11-11.

According to the invention, each plate 10 comprises, on each side of the axis of symmetry XX, at least three blocking means 40, 41 and 42 for the pivotable arms 30 in three different angular positions relative to the axis of symmetry XX:

a first blocking means 40 corresponding to a minimal angular position P0 called the "storage position", in which each pivotably mounted arm 30 is parallel to the fixed arm 20 and to the axis of symmetry of the plates XX;

a second blocking means 41 corresponding to a maximal angular position P1 called the "loaded transport position", in which each pivotably mounted arm 30 forms an angle $\alpha 1$ with the axis of symmetry XX which is greater than 105°;

a third blocking means 42 corresponding to a first intermediate position P2 called the "vertical fixing position", in which each pivotably mounted arm forms an angle $\alpha 2$ with the axis of symmetry XX which is greater than 90° and less than that of the loaded transport position P1.

The pivotable arms 30 thus comprise a storage position P0 (FIG. 1) in which the support polygon of the plate lift is virtually zero, since the pivotable arms 30 are parallel to the fixed arm 20 and the angle between the arms is virtually non-existent (because of the thickness of the arms).

This position P0 allows minimum space to be taken up when the plate lift is not in use.

In an advantageous embodiment of the invention, each plate also comprises, on each side of the axis of symmetry XX, a fourth means 43 for blocking the pivotable arms 30 in a second intermediate angular position P3 called the "unloaded transport position". In this position P3, each pivotably mounted arm 30 forms an angle α3 with the axis of symmetry XX which is less than 90° and greater than that of the vertical fixing position P2.

In the exemplary embodiment illustrated, the angular blocking means are holes 40, 41, 42, 43 intended to be brought opposite the holes carried by each pivotable arm 30 and intended to receive a removable blocking pin (not shown). Several holes per arm may be provided, which allows an increase in distance between the holes and the pivot axis 34 of the pivotable arms 30, thus improving the blocking stability of the arms in the different angular positions. This embodiment is illustrated in FIG. 2, in which for example the hole 41 is further away from the axis 34 than the hole 42.

FIG. 3 illustrates a plate lift in which the base is in the unloaded transport position P3. In this position, the two pivotable arms are spaced apart from each other by an angle of less than 180°. The plate lift rests on the ground with three orientable castors 21, 31 and with a castor 70 carried by the bottom of the mast.

When moving from the loaded transport position P1 (or vertical fixing position P2) to the unloaded transport position P3, the plate lift is slightly unbalanced opposite the fixed arm 20 relative to the mast, such that it rests on the castor 70 of the mast. The pivotable arms 30 are nonetheless spaced apart from each other, forming a support polygon between the wheels of the pivotable arms 30 and the castor 70 of the mast which is sufficient for the plate lift to be stable and to allow it to be transported between two rooms without having to be dismantled.

In accordance with an embodiment of the invention, the castor 70 is fixed to the bottom of the mast by a pin 71 perpendicular to the axis of symmetry XX of the plates 10.

The diameter of the castor 70 and the position of its axis relative to the terminal end 202 of the mast 200 are selected such that:

- the castor does not touch the ground when the pivotable arms 30 are deployed in the loaded transport position P1 and in the vertical fixing position P2; and that
- the castor 70 comes into contact with the ground when the pivotable arms 30 are deployed in the unloaded transport position P3, a tilt angle β of the mast 200 between the loaded transport position P1 (or the vertical fixing position P2) and the unloaded transport position P3 lying between 1° and 4°.

This angle β depends on the length of the arms 30 and in particular on the distance between the castor 70 and the castors 31 carried by the arms 30. It also depends on the diameter of the castor 70, such that the person skilled in the art will be able to place the castor 70 at the bottom of the mast 200 depending on the diameter of the castor 70 he has selected, and on the distance he has selected between the castor 70 and the castors 31.

Thanks to this angle β which lies between 1° and 4°, and the blocking means 43 allowing the pivotable arms 30 to be moved slightly away from the fixed arm 20, it is possible to transport the plate lift in this position in a stable fashion.

The angle α3 generally lies between 10° and 45° and its value depends on the length of the arms 30 selected, such that the plate lift, in the unloaded transport position P3, has a wheelbase which is smaller than the width of standard doors of a building. For example, angle α3 is around 18° for arms of a length (taken between the pivot point and the free end of the arm) between 70 and 75 cm. In this way, the plate lift according to the invention may be transported in a stable fashion between two rooms without having to be completely dismantled, as is the case for plate lifts of the prior art.

FIG. 5 illustrates a plate lift equipped with a rolling base according to the invention in which the movable arms 30 have been deployed into the loaded transport position P1, i.e. the arms 30 are blocked angularly by the blocking means 41 at an angular opening a1 relative to the axis of symmetry XX which is between 105° and 160°.

The angle α1 is selected as a function of the structure of the plate lift and of the distribution of masses within the plate lift, such that the center of gravity of the plate lift lies within the support polygon determined by the castors 30 and 20 in position P1. It is in the loaded transport position P1 that the plate lift is most stable.

Generally, angle α1 lies around 120°.

In this position, the plate lift is perfectly stable and it is possible to transport it even when a material plate is placed on the plate lift 400.

It is in this position that the plate lift 400 is tilted into an angular position in order to load the plate lift with a construction plate B. The plate lift is then tilted into the vertical position as illustrated in FIG. 6.

In a preferred embodiment of the rolling base according to the invention, the pivotable arms 30 comprise a means for fixing a return means 50, intended to be fixed removably between the two pivotable arms 30, when the latter are in the loaded transport position P1.

The return means is advantageously selected from a spring or an elastic strap, at the ends of which hooks are provided which are intended to cooperate with fixing means (for example fixing hoops) carried by the arms 30.

The plate lift is then transported towards the vertical support M on which the construction plate is to be fixed, until the castors 31 come into contact with the vertical support M (FIG. 6).

Before or after this step, the blocking means 41 are deactivated so as to allow free rotation of the arms 30.

Thanks to the return means 50, the arms 30 remain in position P1.

In a variant, to prevent the arms 30 from coming too close together because of the return means, at least one plate comprises a limit stop in order to limit a predefined maximal angular opening of the pivotable arms relative to the axis of symmetry XX.

To be able to apply the construction plate B against the vertical support M, the user pushes the apparatus against the vertical support such that the pivotable arms move apart in the direction of arrow F1, against the return means, until the material plate rests against the vertical support (FIG. 7).

In this position, the pivotable arms are moved apart from each other according to the vertical fixing position. It is possible for the user to block the plate lift in this position by actuating the blocking means 41, or preferably a brake provided on the castor 21 of the fixed arm 20.

The construction plate may then be mounted thanks to the plate lift, then fixed to the vertical support M.

The user then moves the apparatus away from the vertical support, such that the pivotable arms are returned to the loaded transport position by the return means 50.

This return means has thus allowed automatic switching from position P1 to position P2, then back to position P1, without the user having to manage the deployment of the movable arms 30.

The angle α2 between each pivotable arm 30 and the axis of symmetry XX in the vertical fixing position P2 lies between 100° and 115°, provided that this angle α2 remains less than the angle α1 of the loaded transport position P1.

The angle α2 is selected as a function of the length of the pivotable arms 30 and of the position of the plate support in the vertical position, such that the material plate may rest against the vertical support M without the pivotable arms hindering this contact.

The use of a return means 50 therefore allows automatic modulation of angle α1 and angle α2 as a function of the thickness of the material plate to be fixed.

The two pivotable arms 30 therefore comprise a position P1 of angular opening maximizing the support polygon of the plate lift loaded with the fixed arm 20, and a position P2 of angular opening in which the two pivotable arms 30 are moved apart from each other (direction of arrow F1) in order to allow application of a plate against the vertical support M. In this position P2, the support polygon is smaller but the plate lift remains stable because it is resting against the wall.

Thus, the base allows very stable transport of the plate lift from its loading location to the wall, since the arms are in the loaded transport position in which the angular opening optimizes the support polygon, and very stable mounting of the plate since the plate lift is resting against the wall in the vertical fixing position.

In order to facilitate the opening of the pivotable arms 30 during transfer from the loaded transport position P1 to the vertical fixing position P2, the rolling base according to the invention advantageously comprises buffers 60 mounted rotatably between each orientable castor 31 and each arm 30, perpendicularly to the axis of rotation of the castors 31. Each buffer 60 has a maximum diameter D60 which is greater than the maximum diameter D31 of the orientable castors 31. This embodiment is illustrated in FIG. 8.

Thanks to these buffers 60, their diameter greater than that of the wheels and their rotation axis parallel to the support on which they are intended to come to rest, the arms 30 move apart much more easily when the user pushes the plate lift against the vertical support M. In fact, when the user moves the apparatus towards the vertical support, it is these buffers 60 and not the wheels which come into contact with the vertical support. Since the axis of rotation of the buffers 60 is parallel to the vertical support M, the opening of the arms 30 in the direction of arrow F1 (see FIG. 7) is very easy, and there is no risk of the vertical support being damaged by the rubbing of the wheels (as may be the case in the absence of buffers).

The rolling base according to the invention therefore allows very easy handling of the plate lift, in particular during vertical fixing of the plates. It can also be transported very easily between two rooms without having to be totally dismantled. Finally, it offers great stability when the plate lift is not in the usage position (position P1 and P3), while allowing the plate to be effectively applied against a vertical support with a view to its fixing.

Another embodiment of the base 500 according to the invention is illustrated in FIG. 9. In this embodiment, the pivotable arms 501 are mounted pivotably on the mast 200, for example via individual plates 502 (the fixing plate(s) of one arm is/are independent of the fixing plate(s) of the other arm). The blocking means 503 consist of at least three holes 503*a*, 503*b*, 503*c* carried by each of the two pivotably mounted arms, and of two hooks 504 carried by the fixed arm 505 or by the mast 200. On the figure, the hooks are carried by the fixed arm 505.

The holes are arranged such that:

- a first hole (not shown) corresponds to the minimal angular position P0 of storage, in which each pivotably mounted arm is parallel to the fixed arm,
- a second hole 503*a* corresponds to the maximal angular position P1 of loaded transport, in which each pivotably mounted arm 501 forms an angle α1 with the fixed arm 505 which is greater than 105°, preferably between 110° and 160°, advantageously around 120°, and
- a third hole 503*b* corresponds to a first intermediate position P2 of vertical fixing, in which each pivotably mounted arm 501 forms an angle α2 with the fixed arm 505 which is greater than 90° and less than that of the loaded transport position P1, preferably between 100° 115°, provided that this angle remains less than that of the loaded transport position P1.

Preferably, a fourth hole 503*c* is arranged on each arm corresponding to the second intermediate angular position P3 of unloaded transport, in which each pivotably mounted arm 501 forms an angle α3 with the fixed arm 505 which is less than 90° and greater than that of the storage position, preferably between 15° and 45°.

In combination, a return means may be provided between the two pivotable arms, in the same way as described in relation to FIGS. 5 to 7. In this case, the hooks 504 are released from the holes 503*a* in order to leave the arms free to pivot towards each other.

The invention claimed is:

1. A rolling base (100) for a telescopic mast (200) of a plate-lifting apparatus (300), characterized in that the rolling base comprises, with reference to a usage position:

- at least one pair of plates (10) intended to be fixed to a foot (201) of a mast of a lifting apparatus, each plate having an axis of symmetry (XX);
- three arms (20, 30), each provided with an orientable castor (21, 31), one fixed arm (20) being fixed to the mast between two plates in the extension of the axis of symmetry (XX) of the plates, and two arms (30) being mounted pivotably by a pivot axis (34) between two plates, symmetrically and on either side of the fixed arm (20), each pivotal arm including holes;
- each plate comprising, on each side of the axis of symmetry, at least three holes (40, 41, 42) intended to be brought to face the holes carried by each pivotable arm and intended to receive a removable blocking pin for blocking the pivotable arms in three different angular positions (P0, P1, P2) relative to the axis of symmetry (XX):
  - a first blocking hole (40) corresponding to a minimal angular position (P0) called the storage position, in which each pivotably mounted arm is parallel to the fixed arm and to the axis of symmetry (XX) of the plates;
  - a second blocking hole (41) corresponding to a maximal angular position (P1) called a loaded transport position, in which each pivotably mounted arm forms an angle (α1) with the axis of symmetry (XX) which is greater than 105°;
  - a third blocking hole (42) corresponding to a first intermediate position (P2) called the vertical fixing position, in which each pivotably mounted arm forms an angle (α2) with the axis of symmetry (XX) which is greater than 90° and less than that of the loaded transport position (P1);

the second blocking hole (41) being further away from the pivot axis (34) than the third blocking hole (42).

2. The rolling base as claimed in claim 1, wherein each plate furthermore comprises, on each side of the axis of symmetry (XX), a fourth hole (43) for blocking the pivotable arms at a second intermediate angular position (P3) called an unloaded transport position, in which each pivotably mounted arm forms an angle ($\alpha 3$) with the axis of symmetry (XX) which is less than 90° and greater than that of the storage position.

3. The rolling base as claimed in claim 2, wherein the angle ($\alpha 3$) with the axis of symmetry is between 15° and 45°.

4. The rolling base as claimed in claim 1, comprising two pairs of plates, the arms being each formed by a lying U-shaped bracket, each leg (32) of which is mounted pivotably between two plates of a same pair.

5. The rolling base as claimed in claim 1, also comprising a return means (50) intended to be fixed removably between the two pivotable arms when the latter are in the loaded transport position.

6. The rolling base as claimed in claim 5, wherein on each pivotable arm, a rotationally mounted buffer (60) is interposed between each orientable castor (31) and each arm (30), each buffer having a maximum diameter (D60) which is greater than a maximum diameter (D31) of the orientable castors.

7. The rolling base as claimed in claim 5, wherein at least one plate comprises a limit switch to limit a predefined maximal angular opening of the pivotable arms relative to the axis of symmetry.

8. The rolling base as claimed in claim 1, wherein the blocking means consist of at least three holes carried by each of the two pivotably mounted arms, and of two hooks carried by the fixed arm or by the mast.

9. An apparatus for lifting construction plates, comprising a mast, a lifting mechanism and an orientable plate support, characterized in that it comprises a rolling base as claimed in claim 1, fixed to a mast foot.

10. The lifting apparatus as claimed in claim 9, comprising a castor (70) fixed to the bottom of the mast by a pin (71) perpendicular to the axis of symmetry of the plates, the diameter of the castor and the position of its pin being selected such that:

the castor does not touch the ground when the rolling pivotable arms are deployed in the loaded transport position and in the vertical fixing position; and that the castor comes into contact with the ground when the pivotable arms are deployed in the unloaded transport position, a tilt angle ($\beta$) of the mast between the loaded transport position or the vertical fixing position and the unloaded transport position lying between 1° and 4°.

11. A method for positioning and fixing a plate onto a vertical support using a lifting apparatus comprising the following steps:

a1) supplying a lifting apparatus as claimed in claim 9, the rolling base further comprising a return means (50) intended to be fixed removably between the two pivotable arms when the latter are in the loaded transport position;

b1) arranging the arms in the loaded transport position;

c1) fixing the return means between the arms;

d1) placing a construction plate on the plate support;

e1) orienting the plate support vertically such that the plate is vertical;

f1) moving the apparatus towards the vertical support until the castors come into contact with the vertical support;

g1) pushing the apparatus against the vertical support such that the pivotable arms move apart relative to the return means until the material plate rests against the vertical support;

h1) fixing the plate;

i1) moving the apparatus away from the vertical support such that the pivotable arms are returned to the loaded transport position by the return means.

12. A method for positioning and fixing a plate on a vertical support using a lifting apparatus comprising the following steps:

a2) supplying a lifting apparatus as claimed in claim 9, wherein on each pivotable arm, a rotationally mounted buffer (60) is interposed between each orientable castor (31) and each arm (30), each buffer having a maximum diameter (D60) which is greater than a maximum diameter (D31) of the orientable castors;

b2) arranging the arms in the loaded transport position;

c2) fixing a return means between the arms;

d2) placing a construction plate on the plate support;

e2) orienting the plate support vertically such that the plate is vertical;

f2) moving the apparatus towards the vertical support until the buffers come into contact with the vertical support;

g2) pushing the apparatus against the vertical support such that the pivotable arms move apart relative to the return means until the material plate rests against the vertical support;

h2) fixing the plate;

i2) moving the apparatus away from the vertical support such that the pivotable arms are returned to the loaded transport position by the return means.

13. The rolling base as claimed in claim 1, wherein the angle ($\alpha 1$) with the axis of symmetry is between 110° and 160°.

14. The rolling base as claimed in claim 13, wherein the angle ($\alpha 1$) with the axis of symmetry is around 120°.

15. The rolling base as claimed in claim 1, wherein the angle ($\alpha 2$) with the axis of symmetry is between 100° and 115°, provided that the angle ($\alpha 2$) remains less than the loaded transport position (P1).

* * * * *